US005664722A

United States Patent [19]

Marks

[11] Patent Number: 5,664,722

[45] Date of Patent: Sep. 9, 1997

[54] FORWARD ACTING, FORWARD GRIP, STAPLE MACHINE

[75] Inventor: Joel Steven Marks, Los Angeles, Calif.

[73] Assignee: Worktools, Inc., Chatsworth, Calif.

[21] Appl. No.: 563,746

[22] Filed: Nov. 29, 1995

Related U.S. Application Data

[63] Continuation of Ser. No. 268,278, Jun. 30, 1994, abandoned, which is a continuation of Ser. No. 141,437, Oct. 22, 1993, abandoned, which is a continuation of Ser. No. 899,748, Jun. 17, 1992, abandoned.

[51] Int. Cl.[6] ..... B25C 5/11

[52] U.S. Cl. ..... 227/132; 227/146

[58] Field of Search ..... 227/128, 132, 227/146; 173/202, 120; 267/158, 47, 160, 181

[56] References Cited

U.S. PATENT DOCUMENTS

| | | | |
|---|---|---|---|
| 1,919,373 | 7/1933 | Krantz . | |
| 2,326,540 | 8/1943 | Krantz . | |
| 2,412,620 | 12/1946 | Kipp | 227/132 |
| 2,671,215 | 3/1954 | Abrams . | |
| 2,769,174 | 11/1956 | Libert . | |
| 3,610,505 | 10/1971 | Males et al. . | |
| 4,089,099 | 5/1978 | Nivet . | |
| 4,126,260 | 11/1978 | Mickelsson . | |
| 4,184,620 | 1/1980 | Ewig | 227/146 X |
| 4,204,622 | 5/1980 | Smith et al. . | |
| 4,399,938 | 8/1983 | Biddle . | |
| 4,452,388 | 6/1984 | Fealey . | |
| 4,483,066 | 11/1984 | Akira . | |
| 4,629,108 | 12/1986 | Judge . | |
| 4,640,451 | 2/1987 | Steiner et al. . | |
| 5,009,356 | 4/1991 | Chang | 227/128 X |

FOREIGN PATENT DOCUMENTS

| | | | |
|---|---|---|---|
| 0254775 | 7/1986 | European Pat. Off. . | |
| 0281541 | 2/1988 | European Pat. Off. . | |
| 2477458 | 9/1981 | France | 227/132 |
| 2856621 | 7/1980 | Germany | 227/132 |
| 807937 | 1/1959 | United Kingdom | 227/132 |
| 1364336 | 5/1972 | United Kingdom . | |
| 2032327 | 5/1980 | United Kingdom | 227/132 |
| 2229129 | 9/1990 | United Kingdom . | |

*Primary Examiner*—Rinaldi I. Rada

*Attorney, Agent, or Firm*—Paul Y. Feng; Fulwider Patton Lee & Utecht

[57] ABSTRACT

A manually powered fastening tool which stores and instantly releases the energy of a spring such that it may force a fastener into an object by an impact blow in which the operating handle is hinged near the end of the tool body opposite the end from which the staples exit. The main spring is a single piece flat torsion spring which decreases in cross-section away from its fulcrum point to enable the entire spring to provide energy storage. The operating handle is linked to the spring through a low friction rolling element which provides varying leverage to allow a constant operating force through the operating handle motion. The staple guide track includes position and latch feature within a one piece assembly.

13 Claims, 6 Drawing Sheets

FORWARD ACTING, FORWARD GRIP, STAPLE MACHINE

This is a continuation of U.S. application Ser. No. 08/268,278, filed Jun. 30, 1994, which is a continuation of U.S. application Ser. No. 08/141,437, filed Oct. 22, 1993, which is a continuation of U.S. application Ser. No. 07/899,748, filed Jun. 17, 1992, all abandoned.

BACKGROUND OF THE INVENTION

The present invention generally relates to manually powered fastening devices, and more specifically to impact driven staple guns and tacking machines.

FIELD OF THE INVENTION

The fastening tool of the present invention is similar to that described in U.S. patent application Ser. No. 07/772,536, which has been allowed in part and has issued as U.S. Pat. No. 5,165,589. The fastening tool enables an operator's single hand to compress a spring to store and instantly release the energy of the spring to expel a staple from the fastening tool by an impact blow. The fastening tool incorporates a forward acting actuator lever. The staples exit towards the front end of the fastening tool while the lever is hinged near the rear end of the fastening tool. The tool may be gripped through an opening in the body of the tool. The opening extends to the front of the tool, and in certain configurations, the opening may originate at the front of the body of the tool.

U.S. Pat. No. 2,671,215 issued to Abrams discloses the familiar Arrow stapler. A lever is pivoted towards the front of the staple gun. Pressing down the lever behind the pivot compresses a coil spring and raises a plunger. Once the lever is depressed to a predetermined point, the lever is disconnected from the plunger assembly and the plunger is driven downwards by the force stored in the coil spring. The coil spring is located immediately adjacent to, or above, the plunger. The plunger is located in the front of the staple gun. A protrusion extends in front of the front plane of the staple gun in order to accommodate mechanics associated with the plunger. Functional components occupy an approximately two and one half inch region between the front of the staple gun and the hand grip opening. The staple feeder is releasably connected to the back of the staple gun. The entire feeder assembly can be removed, and additional staples inserted into a channel. The feeder is completely separated from the staple gun during this process.

U.S. Pat. No. 3,610,505 issued to Males discloses a design similar to the Abrams design. A lever is pivoted near the front of a staple gun. Pressing the extended arm of the lever downwards towards the rear of the staple gun causes a coil spring to compress and simultaneously raises a plunger. Once the lever has been lowered past a predetermined point, the lever is released from the coil spring and plunger assembly, and the force stored in the coil spring is allowed to drive the plunger downwards, striking and ejecting a staple. The plunger is located at the front of the staple gun. A nose piece extends beyond the front plane of the staple gun in order to accommodate mechanics associated with the plunger. Functional components occupy an approximately two inch region between the front of the staple gun and the hand grip opening. The staple feeder must be fully removed to load additional staples. The staple feeder includes a spring which extends substantially the entire length of the staple gun and wraps around a pivot point located near the front of the staple gun. Unlike the Abrams device in which a spring is compressed in order to force staples to the front of the staple gun, with the Males device, the spring is stretched in order to force staples to the front of the staple gun.

U.S. Pat. No. 2,326,540 issued to Krantz discloses a staple gun in which the actuation lever is pivoted towards the rear of the staple gun. Through a series of levers, this action is connected to a coil spring and plunger located at the front of the staple gun. As the lever arm is lowered, the spring is compressed and the plunger is raised. Once the lever reaches a predetermined point, it is disconnected from the plunger and coil spring assembly, and the energy stored in the coil spring is allowed to release, driving the plunger downward, striking and expelling a staple. In order to accommodate interconnection of the plunger and coil spring assembly, a nose piece which extends in front of the front plane of the staple gun is attached. Functional components occupy an approximately two inch region between the front of the staple gun and the hand grip opening. It appears that the staple feeding mechanism consists of a wound spring assembly which is connected by cable to an end member which sits in the staple channel, forcing the staples towards the front of the staple gun. The end member must be removed from the back of the staple gun in order to add staples. Once removed, the end member will be pulled in a position adjacent to the body of the staple gun immediately above the staple channel.

U.S. Pat. No. 2,769,174 issued to Libert describes a staple gun in which the actuation lever is pivoted at a point towards the rear of the staple gun, and staples are expelled out of the front of the staple gun. Pressing down on the actuation arm towards the bottom of the staple gun compresses a coil spring and raises the plunger. At a predetermined point, the lever is disconnected from the coil spring and plunger assembly, and the energy stored by the coil spring is allowed to release, driving the plunger downwards, striking and expelling a staple. Functional components occupy an approximately two inch region between the front of the staple gun and the hand grip opening. Staple loading is accomplished by completely removing the feeder mechanism, which is extremely similar to the feeding mechanism of the Abrams device.

U.S. Pat. No. 4,629,108 issued to Judge describes a stamped metallic frame which is enclosed in a second stamped or molded housing. Judge describes a common mechanism to accommodate an actuation lever pivoted near the rear of the staple gun. The mechanism provides a typical linking lever location in front and above the hand grip opening. Functional components occupy an approximately two and one half inch region between the front of the staple gun and the hand grip opening.

United Kingdom Patent Application GB 2,229,129A by Chang discloses a desk top stapler which cannot be removed from its base to function as a portable staple gun in a manner similar to the earlier described inventions or the present invention. As shown in FIG. 3, plunger 1 is elevated above the fastener channel in the resting state, and spring 2 is pre-stressed. Plunger 1 is released when the handle is pressed downwards. The device is purportedly "reloaded" or "reenergized" when the user releases the handle, with spring 4 supplying the "resumptive" force to re-stress spring 2. There is no means provided to link the resumptive force of spring 4 to any action which could reset spring 2. Hence, there is no way to return to the configuration shown in FIG. 3 from that shown in FIG. 4, and hence no way for the device to function. Presuming that the '129 reference were to function as described, the plunger will be driven downward by spring 2, which is loaded in the resting state, and is released when the handle is actuated.

The '129 reference is similar in overall shape and in function to other heavy duty desk top staplers. Like other desk top staplers, '129 is not expected or intended to feature a hand grip opening, nor is allowance for such an alternate configuration mentioned or claimed in the patent application. The nature of the '129 design prevents a hand grip opening from being designed into the device because it requires a large lever 3 located in the area immediately above and behind the plunger. Spring member 2 is located substantially in the middle of the body of the '129 fastener, just below lever 3. The area below spring 2 is shown in FIG. 4 to provide structural support. If the structural support could be removed, spring 2 would prevent forming a hand grip opening near the plunger in the '129 device. Lever 3 further hinders such an opening.

LaPointe et al. U.S. Pat. No. 3,862,712 discloses a staple guiding track which slides rearward to expose a chamber in the staple gun body into which staples are placed. The staple gun is inverted during the loading operation. This sliding mechanism requires numerous components and assembly operations for its manufacture.

All of the above described staple guns feature a hand grip opening in the tool body which is two inches or more behind the front of the tool. The space between the front of the tool and the hand grip opening is occupied by the components which link the actuating lever to the plunger. It is not possible to locate the hand grip opening near the front of the above described staple guns.

The above-described staple guns employ a large number of discrete components which must be precisely assembled in order to function correctly. In addition, all of the operative devices described above store energy by compressing a coil spring.

SUMMARY OF THE INVENTION

A need therefore exists for a staple gun which employs fewer parts and is simpler to assemble than the prior art, is forward actuating, may be gripped and operated near its front end, and has an efficient and easy to use staple loading mechanism.

Accordingly, it is an object of the present invention to provide a front actuated staple gun which is highly efficient, and imparts greater energy to the plunger than do prior art devices. It is a primary objective of the present invention to provide a staple gun which may be gripped and operated near its front end using only one hand.

It is a further object of the present invention to provide a more efficient staple loading mechanism.

It is a further object of the present invention to provide a hand motion or a fastening machine which effectively requires less effort to produce a superior stapling result than the prior art.

It is a further object of the present invention to provide a fastening device design in which the force applied to the actuation lever will maximally bias the fastening device towards the object being fastened.

It is a further object of the present invention to provide a fastening device which is optimized for single hand operation.

It is a further object of the present invention to provide a fastening device which operates with minimal shock to the operator upon fastener ejection.

It is a further object of the present invention to provide a fastening device which requires a substantially constant force to be applied to the actuation lever.

It is a further object of the present invention to provide a fastening device which operates with a minimum of parasitic friction.

It is a further object of the present invention to provide a fastening device which comprises a die cast metal housing which is inexpensive and well contoured for comfortable operation.

It is a further object of the present invention to provide a fastening device which employs a minimum number of parts which can be easily and efficiently assembled.

The present invention employs a forward-acting actuation lever which stores energy in a torque transmitting spring while raising a plunger located in the front of the fastening device. At a predetermined point, the actuation lever is released from the spring and plunger assembly, allowing the energy in the spring to drive the plunger downwards, striking and expelling a fastener. A torque transmitting spring, such as a bar, flat, or leaf spring, or a coiled wire torsion spring allows a low reciprocating mass design when compared to the more common coiled wire compression spring, all of the torque transmitting springs mentioned above store energy by bending or flexing about a fulcrum point. Use of a flat tapered torque transmitting spring allows uniform distribution of stress along the length of the single, flat spring as described in the detailed description. The present invention features a fully surrounded hand grip opening extending to the front of the tool body. A stop for the index finger of the gripping hand is provided at the extreme front end of the grip opening.

The present invention also employs a novel fastener loading, guiding and feeding system in which a release lever is pulled towards the back of the fastening device, thus allowing a channel to be lowered along the front of the device. The channel is pivoted towards the back of the device. Staples, or other suitable fasteners, are then placed on the channel. To re-engage the staple loading mechanism, the channel is pushed toward the body of the fastening device, and the loading mechanism reset.

Loading fasteners into the tool of the present invention requires few steps and minimal contortions of the operator's hand. The operating hand may continue to hold the tool without altering its grip while the second hand performs the few steps required to load fasteners. Another innovation of the present loading system is reduced part count. In an embodiment, three discreet parts are required to manufacture the staple guiding and feeding system.

DETAILED DESCRIPTION OF THE PREFERRED EMBODIMENT

Figure 1:
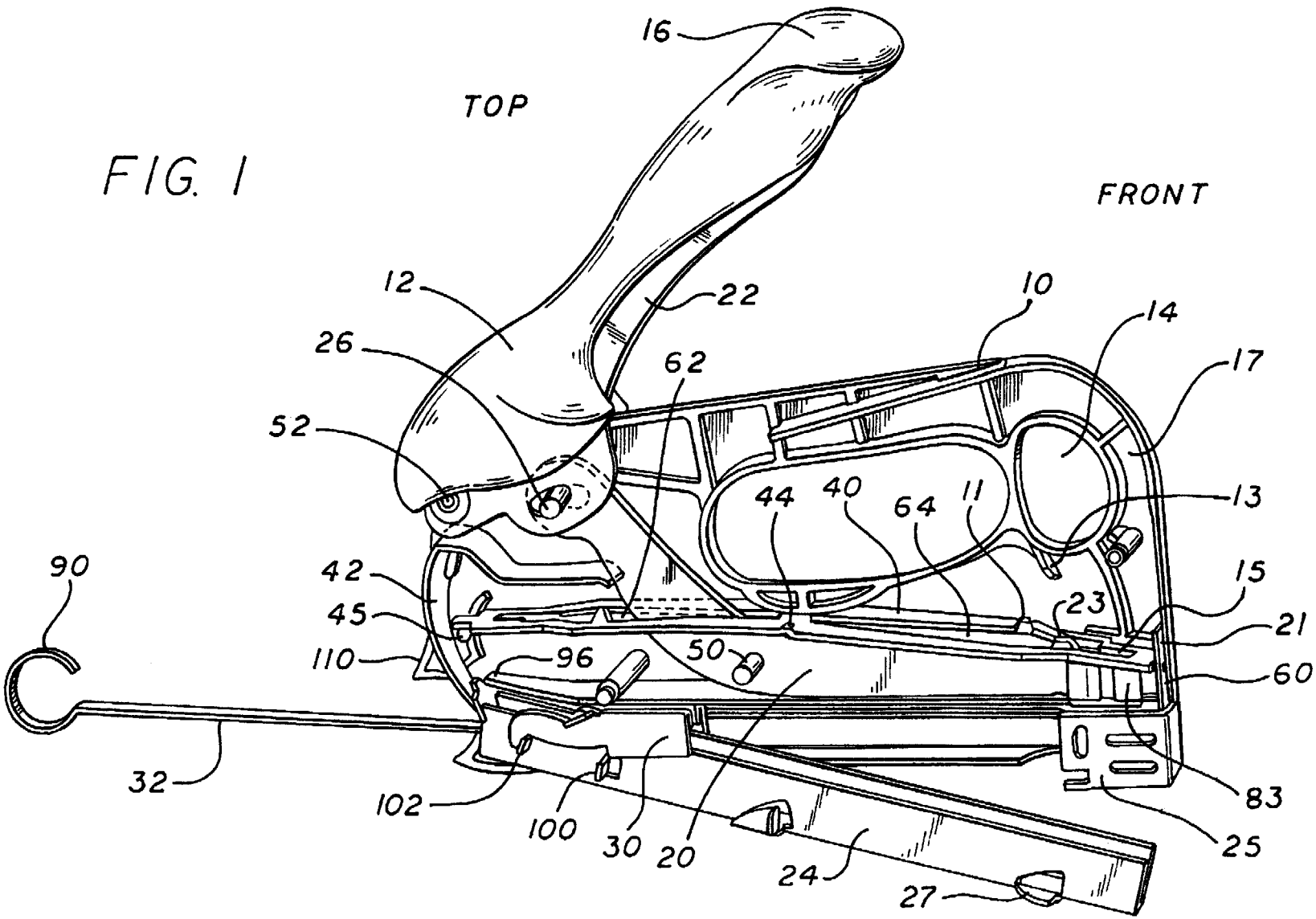
FIG. 1 is a perspective view, with one half of the housing removed, of a fastening tool.

Referring to FIG. 1, die-cast metal housing 10 consists of two opposing halves joined together to contain, guide and hold the internal components of the fastening tool in a predetermined position. Housing 10 is contoured throughout the gripping region for comfortable operation. Opening 14 in metal housing 10 is provided to receive the index finger of a hand as it grips the fastening tool. Finger stop 17 provides a surface for the index finger to support the tool when the tool is held vertically. Molded handle cover 12 provides a thumb rest surface 16 such that an operator's thumb may rest over and past the end of the handle and opposite pivot 52 Shock absorber 83 limits the travel of the spring 40 and plunger 21.

Pivot 52 is a post which is integral to housing 10. Handle cover 12 fits over, and covers the top portion of lever 22. Roller linkage 26 passes through corresponding slots in levers 20 and 22. Force is transmitted through roller linkage 26 from lever 22 to lever 20 to cause lever 20 to pivot about pivot 50. Pivot 50 is a pin linkage identical in shape to roller linkage 26. As portion 16 of lever 22 is pressed towards housing 10, the force is transmitted through linkage 26 to lever 20, causing lever 20 to pivot about pivot 50. As lever 22 is further depressed towards housing 10, the force being transmitted from lever 22 to lever 20 is increasingly transmitted tangentially relative to pivot 50. Since linkage 26 provides substantially no friction, the arrangement provides varying leverage to deflect spring 40.

Figure 3:
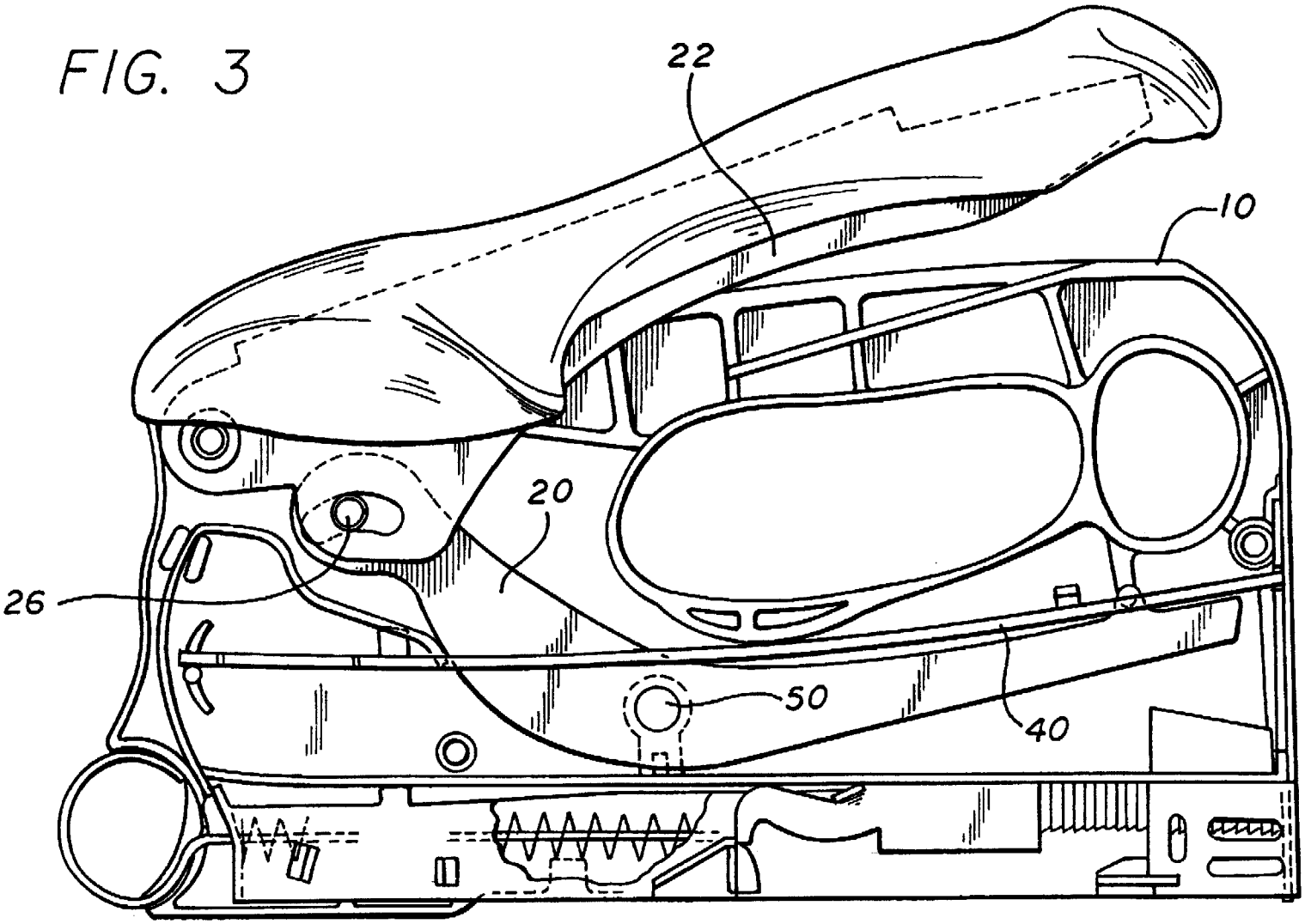
FIG. 3 is a side elevation of the fastening tool of FIG. 1, with the grip handle fully drawn toward the tool body and spring energized as the tool would appear just prior to ejection of a staple.

Pin or roller linkage 26 rolls within slots 28 and 29 of levers 20 and 22. Lever 22 has an identical second slot 29 behind slot 28 of lever 20 to provide even loading on roller linkage 26. The second slot is not visible in the drawings. In FIG. 3, roller linkage 26 is confined in a circular cavity formed by the slot ends of slots 28 and 29.

Relatively slight motion of lever 22 produces a relatively large motion in lever 20 as portion 16 of lever 22 is initially pressed towards housing 10. Near the end of the downstroke of lever 22 the relationship is reversed, and a larger motion of lever 22 is required to produce a smaller motion in lever 20 as portion 16 of lever 22 is pressed towards housing 10. The net effect is that lever 22 requires an essentially constant force through its range of motion even though the force applied to lever 20 increases due to the increasing deflection of spring 40.

Figure 5:
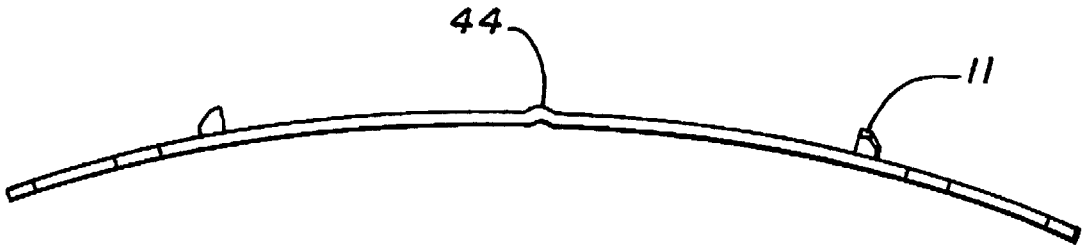
FIG. 5 is a side elevation view of the flat spring of an embodiment of the present invention.
Figure 6:
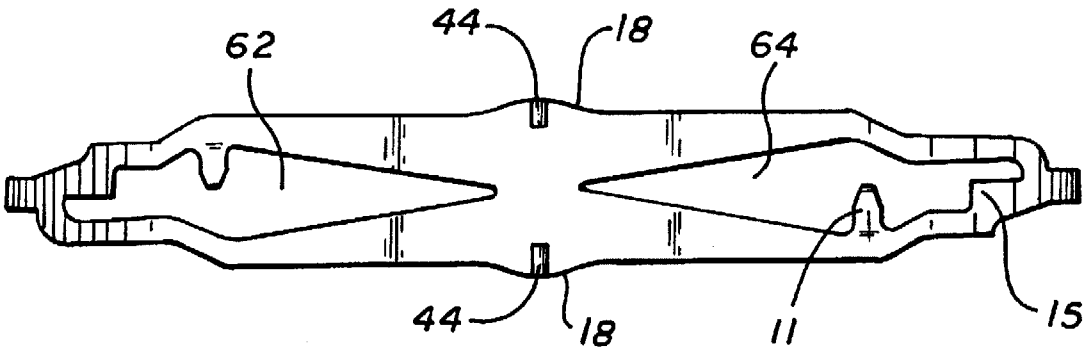
FIG. 6 is a view from below of the spring of FIG. 5.

Spring 40 is preloaded in its resting state to provide resistance at the start of the displacement of lever 22. Spring 40 deflects about fulcrum point 44 upon fulcrum support 43 of housing 10 (see FIG. 1), is held at one end by rear support 45, and moves up and down at the opposite end where it is connected to plunger 21 through slot 60. Spring 40 is shown in more detail in FIGS. 5 and 6. Spring 40 is held in position within housing 10 by protrusions 18 (FIG. 6). Spring 40 has constant thickness and a varying effective width. This variation in the effective width of spring 40 is accomplished by openings 62 and 64 in spring 40. Preferably, openings 62 and 64 are identical, allowing spring 40 to be more easily assembled into the fastening tool. Openings 62 and 64 thus provide a tapered width of spring 40. Spring 40 is wider at the center of the spring near protrusions 18, and is effectively narrower towards the ends of spring 40.

Figure 2:
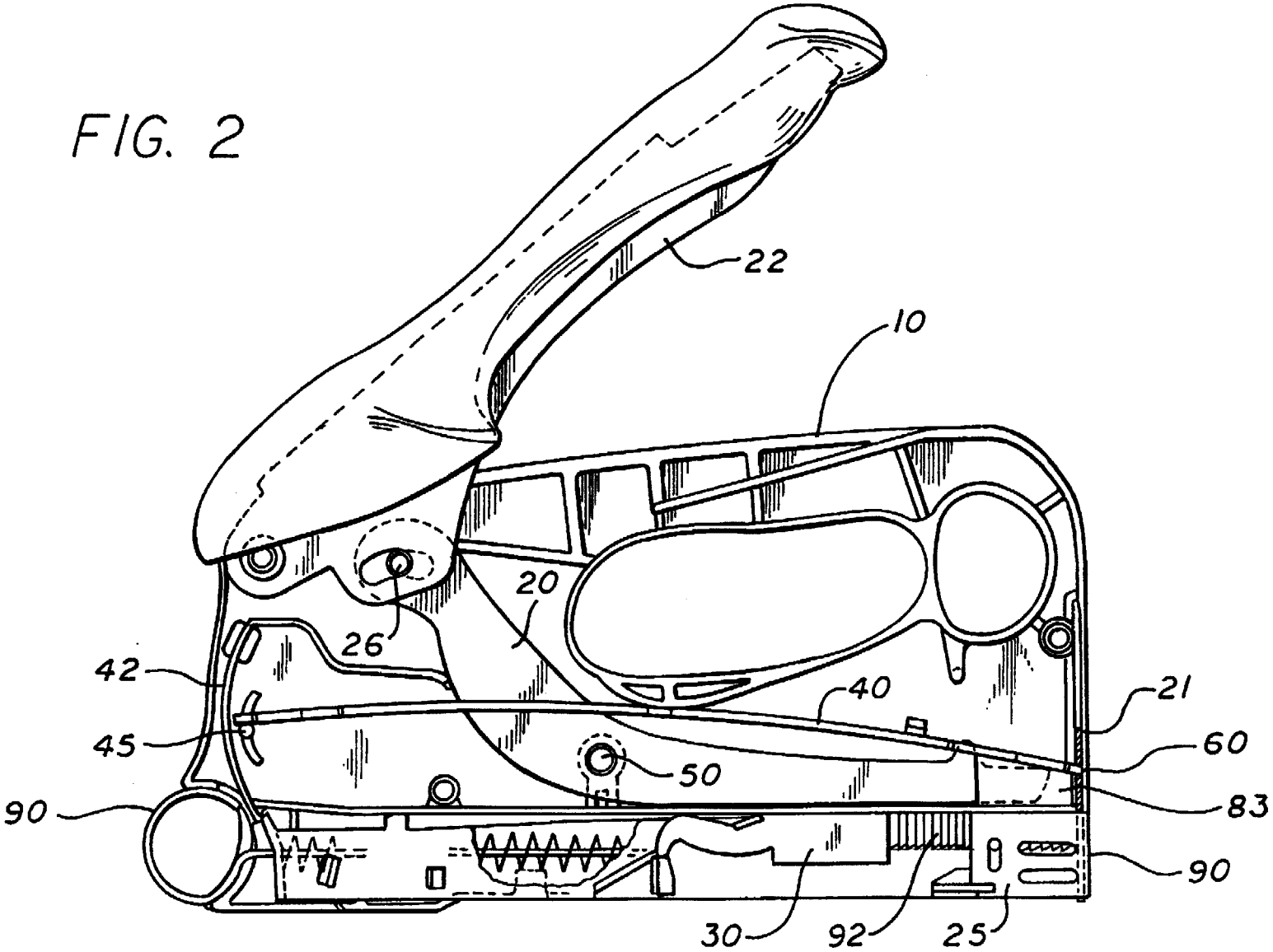
FIG. 2 is a side elevation of the fastening tool of FIG. 1, with its grip handle in an extended position and spring in its rest state, as the tool would appear before commencing an operating sequence.

Referring to FIG. 1, lever 20 makes contact with spring 40 beneath portion 15, which is located near the end of spring 40 (see FIG. 6) and is near slot 60 in plunger 21. As lever 22 is lowered, force is transmitted through linkage 26 to lever 20 causing lever 20 to rotate about pivot 50 and apply upward force to section 15 of spring 40. Because the material cross-section of spring 40 decreases (relatively linearly) from the center of spring 40 to the ends thereof, as shown in FIG. 6, the stress within spring 40 is substantially constant along the entire length of spring 40. The stress is constant because the cross-section of spring 40 is decreasing away from fulcrum 44 and protrusions 18, while the torque upon spring 40 decreases similarly away from fulcrum 44 and protrusions 18. As shown in FIG. 2, note that the plunger 21 is free to slide within a vertical slot located at the front part of the housing 10.

As lever 20 applies upward force on section 15 of spring 40, and raises section 15 of spring 40 as handle 22 is lowered towards housing 10, as shown in FIG. 3, plunger 21 will be raised upwards by the interconnection of spring 40 with slot 60 in plunger 21. An angled tab 23 is located near the end of lever 20 where lever 20 comes in contact with section 15 of spring 40. As lever 22 continues to be pressed towards housing 10, it forces section 15 of spring 40, and plunger 21 upwards within the body of the tool, until angled tab 23 comes into contact with the angled edge of protrusion 13 of housing 10.

As the end of lever 20 which presses on section 15 of spring 40 continues to be raised, angled tab 23 is pressed against the angled edge of protrusion 13. Protrusion 13 is part of housing 10. Protrusion 13 forces lever 20 to slide sidewards because of the contact between protrusion 13 and angled tab 23. This forces lever 20 to slide out from under section 15 of spring 40.

At this point, spring 40 is no longer being forced upwards by lever 20. Spring 40 is free to move, and release the energy stored in spring 40. By releasing the energy stored in spring 40, section 15 of spring 40 is driven downwards, towards the bottom of the fastening tool. Since plunger 21 is connected to spring 40 through slot 60, plunger 21 is thus forced downwards by the motion of spring 40.

Lever 20 is free to wobble slightly about linkage 26 and pivot pin 50 in order to allow sideways movement of the end of lever 20 beneath segment 15 of spring 40. The configuration of lever 20 and spring 40 after lever 20 has been released from section 15 of spring 40 is shown in FIG. 4.

Figure 4:
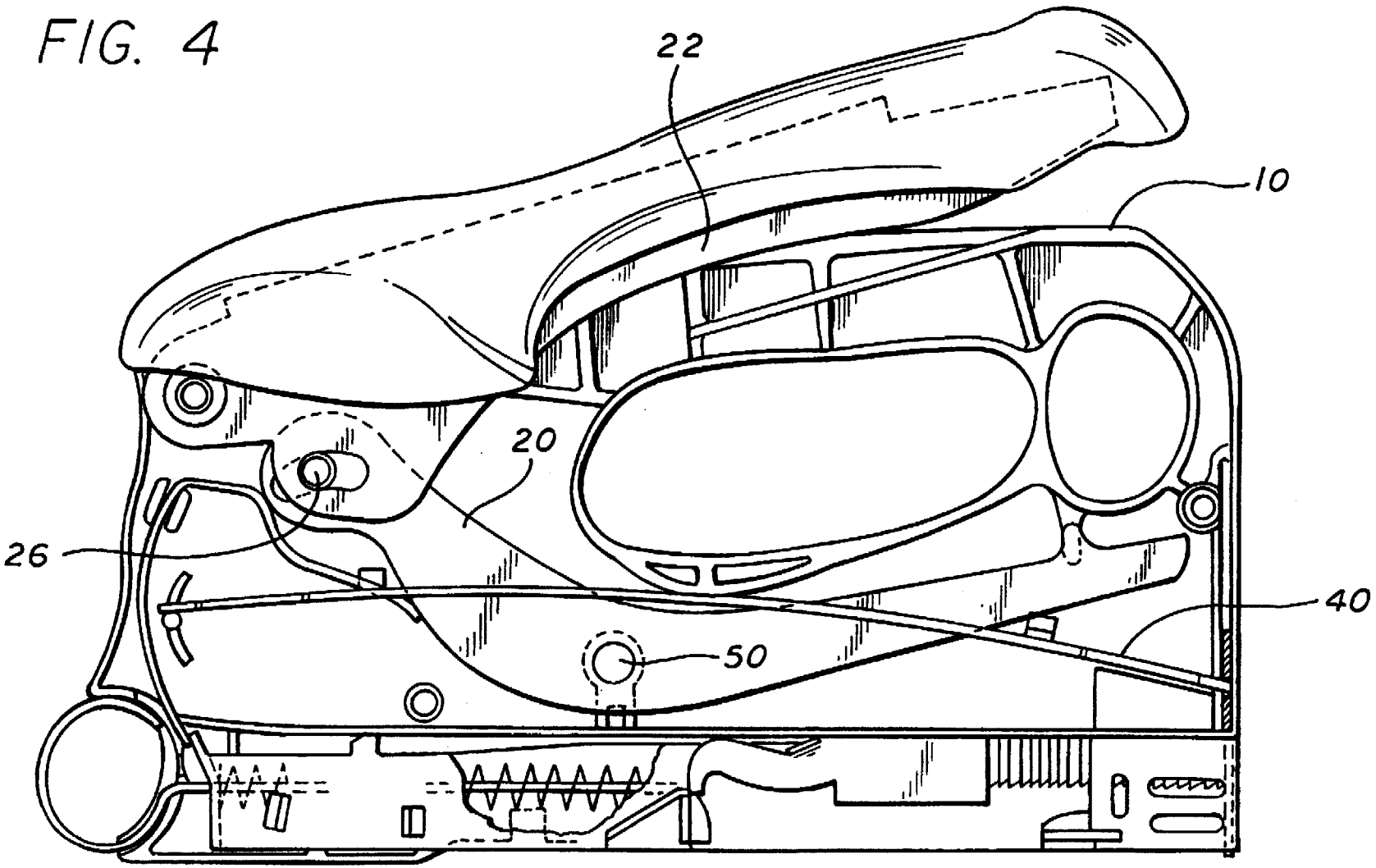
FIG. 4 is a side elevation of the fastening tool of FIG. 1, with the spring in its rest state and the handle fully drawn toward the tool body, as the tool would appear just after ejection of a staple.

Referring to FIG. 2, after lever 22 has been pressed towards the bottom of housing 10 and spring 40 has been released from lever 20, as shown in FIG. 4, the operator will release lever 22. Secondary spring 42 (see FIG. 1) is supported with housing 10 near pivot point 52 of lever 22. Secondary spring 42 exerts pressure on lever 20 to cause the portion of lever 20 linked to lever 22 through pivot 26 to move upwards, thus raising lever 22 to the starting (rest) position. As lever 22 returns to its initial position, the portion of lever 20 which had been positioned beneath segment 15 of spring 40 is lowered towards the bottom of housing 10. This end of lever 20 must again become positioned beneath segment 15 of spring 40 in order for the device to be actuated during the next downstroke of lever 22.

To allow this to occur, tab 11 is located on spring 40 near section 15 thereof. Tab 11 is oriented so that it does not interfere with or make contact with lever 20 as lever 20 presses upwards on section 15 of spring 40. During the downward motion of the end of lever 20 near section 15 of spring 40, tab 11 deflects lever 20 away from section 15 of spring 40 until lever 20 has passed beneath spring 40. Once lever 20 has passed beneath spring 40, lever 20 will again become positioned beneath section 15 of spring 40. Secondary spring 42 is biased to apply force to lever 20 in order to force the end of lever 20 to become located beneath section 15 of spring 40. The wobble about the axis defined by the distinct locations of roller linkage 26 and pin 50 allows lever 20 to be positioned under or beside section 15 of spring 40.

In an alternate embodiment, pin 50 is free to roll in respective slots in housing 10 and lever 20. In this configuration section 15 would extend fully across the inner width of spring 40. Lever 20 would disengage section 15 of spring 40 by translating rearward rollably about pin 50. To substantially eliminate friction at translatable linkage 26, the linkage is comprised of a single piece roller bearing. This bearing is not fixed to housing 10 in any way, but rather forms a rolling contact between levers 20 and 22. This design allows roller bearing 26 and pivot pin 50 to be identical in order to ease manufacturing, even though pivot pin 50 serves only as a pivot pin in the embodiment shown. Roller bearing 26 rolls under a load within corresponding slots within levers 20 and 22. The roller bearing functions repeatedly within the slots without requiring additional positioning components, although such a bearing is free to fall to a skewed angle within the slots during the unloaded resetting operation. At the end of the return stroke, the linked components are lightly forced to the furthest end of their respective slots. The inside walls of housing 10 confine bearing 26 in the axial direction. The roller is then constrained in an effective circular cavity formed by the stacked slots. As the mechanism of the tool is engaged under load, the bearing will roll within the slots contained in levers 20 and 22. Because of the contact friction between the bearing and slots, and a geometry which keeps the slot edges relatively parallel to each other at the point of contact with the bearing, the roller will not slide out of position as long as the load is present.

Figure 7:
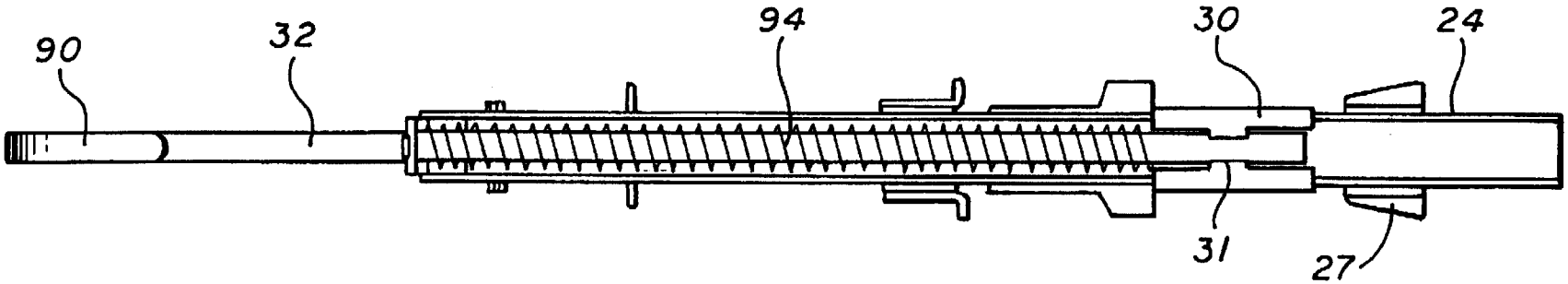
FIG. 7 is a top view of the staple loading system of the invention.
Figure 8:
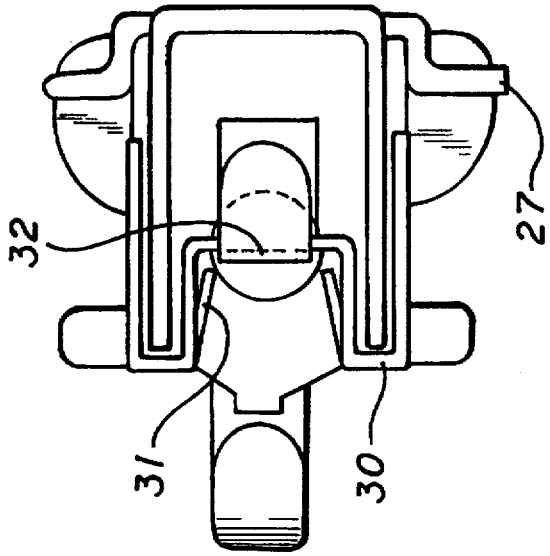
FIG. 8 is the loading system of FIG. 7 viewed from the end opposite the pulling loop.
Figure 9:
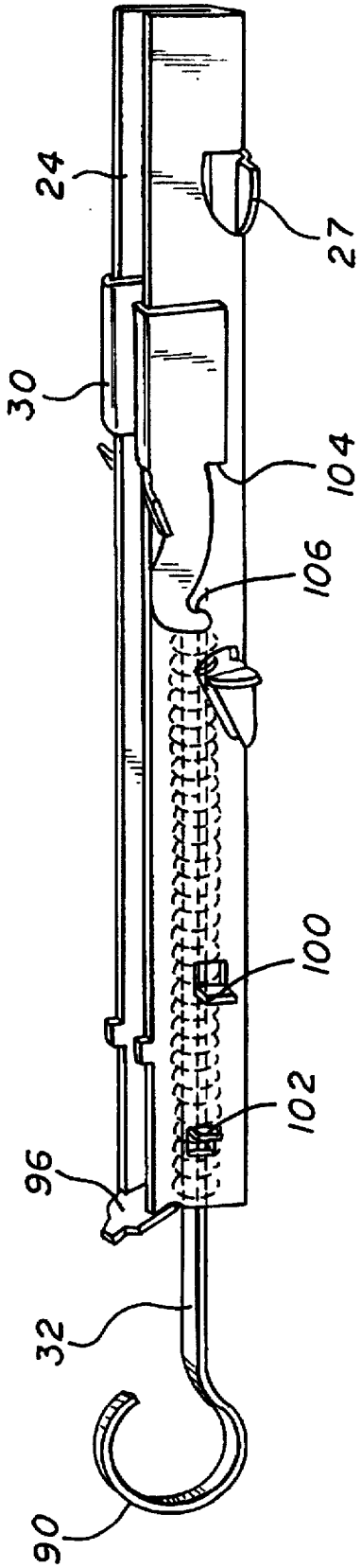
FIG. 9 is a perspective view of the loading system of FIG. 7.

Referring to FIG. 1, to operate the fastener loading system, an operator pulls ring 90 away from housing 10. Ring 90 is connected to a flat wire 32 which in turn is coupled to feeding plunger 30. Feeding plunger 30 is located above track 24, and when in position as shown in FIG. 2, applies force to fasteners 92 to force them towards plunger 21. Feeding plunger 30 maintains pressure against fasteners 92 because of the force applied to feeding plunger 30 by spring 94 (See FIGS. 7–9). Spring 94 is a compression spring which is pressing against stop 96 which is located at the end of track 24 where track 24 pivots away from housing 10. Spring 94 is biased to expand, and thus forces feeding plunger 30 away from stop 96, and towards plunger 21. Feeding plunger 30 is retained upon flat wire 32 by tabs 31.

Track 24 is positioned within steel nose piece 25 by tabs 27 which are located towards the bottom of track 24. Tabs 27 are formed of the same piece comprising track 24. Notches in steel nose piece 25 accommodate tabs 27, thus ensuring that track 24 remains in position within fastener channel 75 of housing 10. Fasteners such as staples 92 may be loaded by placing them on top of channel 24, or by inverting housing 10, and inverting the staples and placing them within fastener channel 75.

Tabs 27 will remain in the notches in nose piece 25 until ring 90 is pulled away from housing 10, pulling feeding plunger 30 away from nose piece 25 until the vertical section 104 of feeding plunger 30 comes into contact with tab 100 located on track 24. At this point, moving ring 90 further away from housing 10 forces feeding plunger 30 to pull channel 24 away from nose piece 25. This causes tabs 27 to disengage from the slots in nose piece 25, allowing track 24 to be pivoted away from body 10.

Once staples have been loaded onto track 24, the operator manually rotates track 24 upwards towards housing 10, and tabs 27 engage mating notches 29 on nose piece 25. When this occurs, the back of track 24 has rotated, and notch 106 on feeding plunger 30 releases from tab 102 on plunger 24 allowing spring 94 to drive feeding plunger 30 towards nose piece 25, thus pressing staples 92 towards plunger 21. Ring 90 is then pushed towards nose piece 25, causing wire 32 to become located in the channel within track 24. Ring 90 is pressed towards nose piece 25 until ring 90 comes to rest beneath section 110 of housing 10.

With staples 92 resting on track 24 and the spring action of spring 94 pressing against feeding plunger 30, staples 92 are forced towards plunger 21. As plunger 21 is raised above the level of staples 92, the staples adjacent to plunger 21 will be forced beneath plunger 21. As plunger 21 and spring 40 are released from lever 20, plunger 21 will expel the staple located immediately beneath plunger 21, applying the energy released by spring 40. In one embodiment, the loading and feeding system comprises just four parts, track 24, feeding plunger 30, wire 32 with ring 90, and spring 94.

The fastening device of the preferred embodiment is designed for ease of manufacturing. Handle 12 is snap fitted onto lever 22, which allows assembly without the use of fasteners. Roller linkage 26 and pivot 50 are identical and interchangeable. Spring 40 is symmetrical about protrusions 18 of housing 10 so that it can be installed either forwards or backwards without any noticeable difference. Spring 42 serves a dual purpose as both a secondary spring which causes lever 22 to return to its fully extended starting position, and also applies force to track 24 to encourage track 24 to pivot away from housing 10 during the staple reloading procedure.

The staple loading and feeding system comprises a minimum of discreet components. The housing 10 is die cast metal and incorporates numerous guiding functions and exterior contours as well as confining particular components to a predetermined, desired area. The two halves of housing 10 are secured together using built-in rivetable posts which do not require separate fasteners.

To enable energy storage along the entire length of spring 40, the spring must become less stiff further from the fulcrum point. A common leaf spring achieves this effect by stacking progressively shorter flat springs atop each other. A more effective approach is to vary the amount of spring material across just one flat spring. In practice the appropriate way to vary the cross section is to vary the width, but not the thickness, of an individual flat spring. In its simplest embodiment such a flat spring has an elongated four sided diamond shape. The long axis is the bending axis and the short axis, or maximum width, is the fulcrum or pivoting axis. If the fulcrum is at the center of the spring, the spring is engaged at its ends and the spring is flat when unloaded, then the spring will maintain an essentially constant bend radius along its length as it is bent. A conventional non-varying flat spring will remain nearly flat toward its endpoints, bending mostly near the fulcrum.

A spring of the design of the present invention is thinner at its fulcrum point compared to conventional stacked flat torque transmitting springs and coiled wire torsion springs capable of equivalent energy storage. Such compactness is essential to minimize the overall height of the tool of the present invention.

There has been described here and above a novel fastening device. Those skilled in the art may now make numerous uses of the teachings of the present invention without departing from the spirit and teachings of the present invention which are defined solely by the scope of the following claims.

What is claimed is:

1. A fastening device comprising:

a housing having a front, back, top, bottom and first and second sides;

a first lever pivoted near the back of said housing;

a plunger located within said housing near the front thereof;

a second lever having first and second ends being linked at said first end to said first lever and releasably linked at said second end to said plunger, said second lever pivotally connected to said housing;

a torque transmitting flat spring pivoting against a fulcrum within said housing and linked at one end to said plunger, said spring decreasing in cross sectional area with increasing distance along the length of said spring away from said fulcrum;

one or more openings through said housing positioned to allow a single hand to grip said first lever and also to grip said housing by passing the fingers of the single hand through said openings.

2. The fastening device described in claim 1 wherein a pivot between said first lever and said housing, a linkage between said first and second levers, and said pivot between said second lever and said housing engage so that with increasing displacement of said first lever from its initial position, said first lever exerts force upon said second lever at the linkage between said first lever and said second lever in an increasingly tangential direction relative to said second lever's pivotal attachment to produce increasing leverage by said first lever upon said second lever, said torque transmitting flat spring being increasingly stressed by the pivotal movement of said first and second levers, said increasing leverage by said first lever on said second lever acting against the increasing stress upon said spring to require a relatively constant force upon said first lever to cause increasing stress upon said spring.

3. The fastening device as described in claim 1 in which said housing is formed of two die cast halves and comprises integral bearing, guiding and positioning surfaces including at least:

an elongated slot in said housing to position and guide said plunger; and in which said housing is contoured for a fit of an operator's hand.

4. A fastening device comprising:

a housing having a front, back, top, bottom and first and second sides;

a first lever pivoted near the back of said housing;

a plunger located within said housing near the front thereof;

a second lever linked at one end to said first lever and releasably linked at the other end to said plunger;

a torque transmitting spring pivoting on a fulcrum within said housing and linked at one end to said plunger;

said second lever passing through an opening in said spring; and one or more openings through said housing to allow a single hand to grip said first lever and grip through said housing.

5. A fastening tool to install fasteners by an impact blow comprising:

a housing to guide and contain mechanical parts;

an elongated torque transmitting spring pivoting on a fulcrum within said housing to store and release energy to install said fasteners;

a lever attached to said housing and linked to said spring such that a user may displace said lever and energize said spring;

said spring being of a substantially constant thickness flat design and having a cross-sectional area that substantially decreases with increasing distance along the length of said spring away from said fulcrum.

6. The fastening device as described in claim 5 in which said spring comprises at least one cavity through its thickness such that a functional component of said fastening tool may pass through said cavity.

7. A fastening tool comprising:

a housing having a top, bottom, first and second sides, a front end, a front, a back, and a length from front to back;

a fastener guide track attached to said housing near the bottom thereof, to guide fasteners towards the front of said housing;

a first opening in said bottom of said housing at said front end of said housing;

a plunger located at said front end of said housing, and having a top and bottom portion, said plunger oriented to expel objects in said fastener guide track through said first opening when said plunger is alternately raised and lowered;

a spring linked to said plunger, oriented to force said plunger towards said first opening, said spring extending rearward from said plunger;

a first lever located substantially above said housing and pivotally connected to said housing near the rear portion of said housing;

a second lever pivotally connected to said housing, elongated rearward from said plunger and linked to said first lever, said second lever further linked to said plunger at a second front end, to transmit pivotal motion of said first lever to cause said plunger to raise, said second lever releasably linked to said plunger such that said second lever will be released from said plunger when said first plunger has reached a predetermined point, causing said spring to force said plunger to lower towards said first opening;

a hand grip opening through said first and second sides of said housing, said hand grip opening elongated along said length of said housing, said hand grip opening extending substantially completely to said front end of said housing and enclosed at said front end by a narrow finger stop structure, said finger stop structure positioned substantially completely at said front end of said housing;

said second lever front end substantially vertically aligned with a front end of said hand grip opening.

8. The fastening device described in claim 7, and further comprising at least a second finger stop structure which spans said hand grip opening, substantially parallel to the first finger stop structure such that said hand grip opening is divided to form at least two distinct openings.

9. A fastening tool to install fasteners by an impact blow comprising:

a housing to guide and contain mechanical parts;

a spring within said housing to store and release energy to install said fasteners;

a cylindrical roller bearing providing a linkage between a first and a second lever, said roller bearing being loosely positioned within respective slots of said first and second levers;

said slots aligned to form a substantially circular cavity to receive said roller bearing when said levers are in an initial position;

wherein alignment of said slots form an elongated cavity as said levers are displaced from an initial position, such that as said roller bearing rolls within the elongating cavity said roller bearing is held stable within said cavity by contact friction between said slots and said roller bearing;

whereby locations within said slots on said first and second levers of said roller bearing contact remain substantially aligned for all displacement positions of said first and second levers; and said roller bearing producing a substantially zero friction linkage by rolling between said lever and linked part.

10. A fastening tool to install fasteners by an impact blow comprising:

a housing to guide and contain mechanical parts;

a first lever pivotally attached within said housing;

an elongated cylindrical roller contacting said first lever within said housing;

a second lever of said fastening tool pressing against said first lever through a linkage comprising said cylindrical roller;

said first and second levers contacting said cylindrical roller at diametrically opposed surfaces of said cylindrical roller to form said linkage across a diameter of said cylindrical roller;

said cylindrical roller rotating between said second lever and said first lever when said second lever is moved relative to said first lever in a direction perpendicular to a long axis of said cylindrical roller.

11. The fastening tool according to claim 10, wherein:

said cylindrical roller contacts said first lever at a first contact surface upon said first lever;

said cylindrical roller contacts said second lever at a second contact surface upon said second lever;

said first contact surface remains parallel to said second contact surface as said second lever is moved relative to said first lever.

12. The fastening tool according to claim 11, wherein at least one of said first and second contact surfaces defines a curve in a direction perpendicular to the long axis of said cylindrical roller.

13. The fastening tool according to claim 11 wherein said first and second contact surfaces feature end structures to limit motion of said cylindrical roller;

end structures causing said cylindrical roller to be entirely contained radially for a particular position of said second lever relative to said first lever.

* * * * *